US007271310B1

(12) United States Patent
Krumhansl et al.

(10) Patent No.: US 7,271,310 B1
(45) Date of Patent: Sep. 18, 2007

(54) CASK WEEPING MITIGATION

(75) Inventors: James L. Krumhansl, Albuquerque, NM (US); Patrick V. Brady, Albuquerque, NM (US); David M. Teter, Edgewood, NM (US); Paul McConnell, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 500 days.

(21) Appl. No.: 10/366,225

(22) Filed: Feb. 12, 2003

Related U.S. Application Data

(60) Provisional application No. 60/375,746, filed on Apr. 26, 2002.

(51) Int. Cl.
*G21F 9/14* (2006.01)

(52) U.S. Cl. ..... 588/18

(58) Field of Classification Search ..... 588/2, 588/13, 15, 16, 18, 20
See application file for complete search history.

(56) References Cited

U.S. PATENT DOCUMENTS 4,469,628 A * 9/1984 Simmons et al. ..... 588/11
4,671,898 A * 6/1987 Hultgren ..... 588/3
5,322,644 A * 6/1994 Dunn et al. ..... 588/7

OTHER PUBLICATIONS

Bennett, P.C., et al., "In-Service Analysis of Cask Contamination Weeping," *Sandia National Laboratories, 9th Annual Symposium on the Packaging and Transportion of Radioactive* Materials, pp. 247-254 (Jun. 1989).

Bennett, P.C., et al., "Scoping Experimental Analysis of Factors Affecting Cask Cntamination Weeping," *SAND90-2249 TTC-1014*, (1990), no month.

Carlson, M., "Physico-Chemical Investigation of Surface Contamination on Nuclear Fuel Containers," *Exam project, Dept of Analytical Chem and Nucl Chem, Uppsala* U, Spring Term 2000, no month.

Dzyombak, D.A., et al., "Surface Complexation Modeling—Hydrous Ferric Oxide," *Textbook*: John Wiley & Sons, pp. 68-69 (1990), no month.

Fletcher, P., et al., "The Chemical Modelling of Clay/Electrolyte Interactions for Montmorillonite," *Clay Minerals*, vol. 24, pp. 375-391 (1989), no month.

Jawarani, D., et al., "Critical Discussion of Relevant Physical Issues Surrounding the Weeping of Nuclear-Waste Casks," *J of Nuclear Materials*, vol. 206, pp. 57=67 (1993), no month.

Tamura, T., "Sorption Phenomena Significant in Radioactive-Waste Disposal," *Underground Waste Management and Environmental Implications*, Memoir No. 18, Amer Assn Petr Geo. (1972) pp. 318-330, no month.

* cited by examiner

*Primary Examiner*—Edward M. Johnson
(74) *Attorney, Agent, or Firm*—Robert D. Watson

(57) ABSTRACT

A method (and concomitant kit) for treating a surface to reduce subsequent $^{137}Cs$ nuclide desorption comprising contacting the surface with a first cation-containing solution, the cation being one or more of $Cs^+$, $Rb^+$, $Ag^+$, $Tl^+$, $K^+$, and $NH_4^+$, and contacting the surface with a second cation-containing solution, the cation being one or more of $Cs^+$, $Rb^+$, $Ag^+$, $Tl^+$, $K^+$, and $NH_4^+$, thereby reducing amounts of radioactive cesium embedded in clays found on the surface.

11 Claims, 5 Drawing Sheets

SEM Micrograph of Kaolin Clay

CASK WEEPING MITIGATION

CROSS-REFERENCE TO RELATED APPLICATIONS

This application claims the benefit of the filing of U.S. Provisional Patent Application Ser. No. 60/375,746, entitled "Preventive Technologies to End Shipping Cask Weeping", filed on Apr. 26, 2002, and the specification thereof is incorporated herein by reference.

GOVERNMENT RIGHTS

The Government has rights to this invention pursuant to Contract No. DE-AC04-94AL85000 awarded by the U.S. Department of Energy.

BACKGROUND OF THE INVENTION

1. Field of the Invention (Technical Field)

The present invention relates to prevention or mitigation of spent nuclear fuel shipping cask weeping.

2. Background Art

Note that the following discussion refers to a number of publications by author(s) and year of publication, and that due to recent publication dates certain publications are not to be considered as prior art vis-à-vis the present invention. Discussion of such publications herein is given for more complete background and is not to be construed as an admission that such publications are prior art for patentability determination purposes.

The phenomenon termed "weeping" is characterized by the occurrence of non-fixed, removable radioactive contamination on the surface of a radioactive material package, at a level exceeding regulatory limits and after prior demonstration that such removable contamination was within allowable limits. This is a persistent problem in the transport of spent fuel from commercial reactors. This problem can be traced primarily to two radioisotopes, $^{137}$Cs and $^{60}$Co, common in spent fuel storage pools.

The following lists prior art methods for the prevention or mitigation of cask surface contamination, with variable or unsubstantiated levels of success:

- Spent-fuel pool cleanliness (contaminant level); pool chemistry (including lower pool pH)
- Minimize cask immersion time (in spent-fuel pool)
- Operational/administrative procedures
  - Standardization of methods for contamination measurement and instrumentation.
- Minimize time interval between removal from the pool and start of decontamination.
- Decontamination/cleaning detergents and agents (including chemical foams)
  - Blocking agents
  - Low pH cleaning solutions
  - Pressurized water decontamination
- Cask surface finish
  - Electro-polish cask surface
  - Stainless steel cask (or other material)
- Protective coatings/barrier on cask surface
  - "Skirt" (mechanical barrier) around cask
  - Paint cask surface
  - Strippable paints
  - Cover cask during transport
- Cask design for ease of decontamination (surface finish and material; minimize protuberances)

- Minimize stress to cask body and surface/air temperature gradients $^{137}$Cs and $^{60}$Co are common radionuclides observed as non-fixed surface contamination when weeping incidents occur. A number of attempts have been made to provide a mechanistic explanation for the seemingly capricious occurrence of cask weeping incidents. Work has been performed at, or sponsored by, Sandia National Laboratories to determine the mechanism(s) of non-fixed surface contamination on package surfaces. This work led to the conclusions that the contamination is 1) an adsorption/desorption phenomenon; or is 2) a physical-chemical process in which radionuclides are incorporated (physically trapped and/or ionically bonded) onto the package surface. The reevaluation of the literature and the Sandia work by the present inventors suggested that while the phenomenological mechanisms previously conjectured were reasonable, a more likely mechanism for $^{137}$Cs weeping is ion exchange involving clay particles affixed to the exterior surfaces of shipping casks.

D. Jawarani, et al., "Critical discussion of relevant physical issues surrounding the weeping of nuclear-waste casks", *J. of Nuclear Materials, v.* 206, p. 57-67 (1993), focused on the role that may be played by the passivating oxide layer on a stainless steel canister, in comparison with Co and Cs retention on painted surfaces. A number of important observations were made:

1. Metal oxides retain radionuclides by a "physical adsorption" mechanism while ion exchange plays a role in the case of painted surfaces. Once the radionuclide is on the surface sorption into the oxide surface coating occurs by diffusion.
2. On painted surfaces the titanium dioxide pigment may play a role in retaining Cs.
3. There is incubation time for the nuclides to reappear on the cask surface.
4. A potential role for road grime is noted but no mechanistic function is assigned to its presence other than to suggest that it initially scavenges radionuclides that are later somehow "locked" into the metal oxide surface coating.
5. Weeping is found to be strongly associated with surface oxide coatings that have developed to the extent that well-defined grain boundaries are present. Blistering, and presumably spalling, of these oxide layers (due to accumulated stresses) may account for weeping incidents. In fact, the oxide breakdown-repassivation cycle may occur numerous times.
6. The possibility of inhibiting the uptake of radionuclides by blocking the sorption sites using $Ba^{2+}$ was postulated and then verified in a preliminary manner.

Although quite general in application, the Jawarani model is somewhat vague regarding the kinds of sites that may be occupied by the various radionuclides in the oxide layers. It is unlikely that surface metal-hydroxyl sites are occupied by cobalt, and particularly not by cesium, since neither element is strongly sorbed by iron oxide. One tentative explanation offered is that radionuclides may be fixed at defects in the lattices where a free electron reduces the ion to a neutral metal atom. After that, it is hypothesized, the neutral atom diffuses with relative ease deeper into the metal oxide layer. In the case of silver, and to a lesser extent cobalt, this is plausible. Cesium, however, is so readily oxidized that this mechanism seems unlikely.

Jawarani et al. also make reference to the importance of various environmental factors:

1. For painted canisters, exposure to humid conditions, or rain, increases the likelihood of weeping.
2. Weathering and exposure to abrasion, dirt, sun, and air all increase the chances of a weeping incident.
3. Low temperatures and low differential temperatures are associated with increased weeping but there is no association between weeping and precipitation or humidity.

Weeping incidents usually are associated with releases of $^{60}Co$ and $^{137}Cs$, though on occasion other radionuclides may be involved. Generally these two radioisotopes behave differently and may be influenced by different environmental factors. Studies to date have focused on the roles played by the surface coatings, paint and metal oxide passivating coatings, but have ignored the impact of road grime. As will become apparent, this component can significantly influence the retention and later release of $^{137}Cs$. In the course of the following discussion it should be kept in mind that the various mechanisms discussed in the literature—and the mechanism emphasized herein—are not mutually exclusive. Thus, depending on local history and environment all may operate in concert and it may not be possible to isolate a single cause for a particular weeping incident.

The present invention is of methods and kits for diminishing the incidents of radioactive $^{137}CS$ contamination arising from the weeping phenomenon. A combination of pre-treatment (prior to placing a shipping cask into a spent fuel storage pool) and post-treatment (after it is removed) decreases residual $^{137}Cs$ on the cask by a factor of 100 while also achieving smaller but still significant decreases in $^{60}Co$ retention. Both pre- and post-treatments involve soaking the shipping cask surface in a solution of monovalent ions such as $Cs^+$ (non-radioactive), $K^+$, and $NH_4^+$. Pre-treatment works by blocking most of the sorption sites where radionuclide retention may occur. Post-treatment establishes conditions favorable to the displacement of sorbed radionuclides and thus facilitates removal of those radioisotopes that do become affixed to the cask surface as the spent fuel is being loaded. The invention is an improvement over the currently employed washing technology (often a rinse with soapy water) in that it targets specific chemical mechanisms (sorption, surface complexation, and ion exchange) responsible for retaining the chief radionuclides of concern during weeping incidents.

SUMMARY OF THE INVENTION (DISCLOSURE OF THE INVENTION)

The present invention is of a method of treating a radioactive material containing package to reduce subsequent nuclide desorption, comprising: prior to loading radioactive material into the package, contacting the package with a cation-containing solution, the cation being one or more of $Cs^+$, $Rb^+$, $Ag^+$, $Tl^+$, $K^+$, and $NH_4^+$; and after loading radioactive material into the package, contacting the package with a cation-containing solution, the cation being one or more of $Cs^+$, $Rb^+$, $Ag^+$, $Tl^+$, $K^+$, and $NH_4^+$. The first contacting step preferably comprises contacting the package with a substantially non-radioactive cation-containing solution comprising $Cs^+$, most preferably a cesium salt solution and most preferably with $Cs^+$ in concentration greater than approximately 0.1 molar. The second contacting step preferably comprises contacting the package with a cation-containing solution, the cation being one or both of $K^+$ and $NH_4^+$, most preferably in concentration greater than approximately 0.1 molar. The second contacting solution preferably additionally comprises one or more complexing agents. Either or both of the contacting steps may employ an absorbent wrap containing the cation-containing solution.

The invention is also of a method of treating a surface to reduce subsequent nuclide desorption, the method comprising the steps of: contacting the surface with a first cation-containing solution, the cation being one or more of $Cs^+$, $Rb^+$, $Ag^+$, $Tl^+$, $K^+$, and $NH_4^+$; and contacting the surface with a second cation-containing solution, the cation being one or more of $Cs^+$, $Rb^+$, $Ag^+$, $Tl^+$, $K^+$, and $NH_4^+$; thereby reducing amounts of radioactive cesium embedded in clays found on the surface. The first contacting step preferably comprises contacting the surface with a substantially non-radioactive cation-containing solution comprising $Cs^+$, most preferably a cesium salt solution and most preferably with $Cs^+$ in concentration greater than approximately 0.1 molar. The second contacting step preferably comprises contacting the surface with a cation-containing solution, the cation being one or both of $K^+$ and $NH_4^+$, most preferably in concentration greater than approximately 0.1 molar. The second contacting solution preferably additionally comprises one or more complexing agents. Either or both of the contacting steps may employ an absorbent wrap containing the cation-containing solution.

The present invention is additionally of a method of treating a radioactive material containing package to reduce subsequent nuclide desorption, comprising: preparing a substantially non-radioactive cation-containing solution, the cation being $Cs^+$; and contacting the package with the cation-containing solution. The contacting step may be performed prior to and/or after loading radioactive material into the package. The solution may additionally comprise one or more complexing agents.

The invention is further of a kit for treating a radioactive material containing package to reduce subsequent nuclide desorption, comprising a container of a substance comprising one or more cesium salts and a container of a substance comprising one or more compounds selected from potassium compounds and ammonium compounds, which containers may be the same container or two different containers. The kit may also comprise one or more complexing agents.

In each case, the one or more complexing agents are preferably one or more of ammonium fluorosilicate, oxalic acid, disodium chromotropic acid, glutamic acid, and sodium salicylate.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 5 illustrates in kaolinite a silicon atom being replaced by an aluminum atom and a charge deficiency developing that must be compensated for by including an extra cation ($K^+$) near by.

DESCRIPTION OF THE PREFERRED EMBODIMENTS

Figure 1:
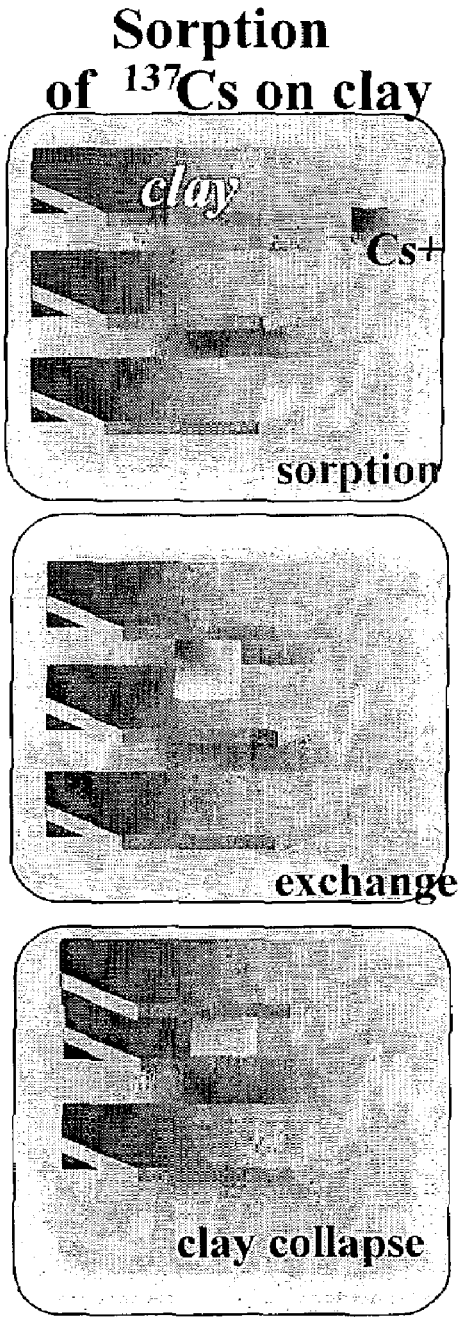
FIG. 1 illustrates the electro-static bonding of $Cs^+$ ions between layers of clay (presumed to be on the surface of a spent fuel package); the reverse of this process, in the presence of cations, which may exchange with cesium between the clay layers, results in release of the cesium to the surface of the package via a mechanism known as ion exchange.

Best Modes for Carrying Out the Invention

A "cask weeping" incident occurs when a spent fuel shipping cask (or other radioactive material containing package) that swiped "clean" for non-fixed radionuclide contamination at the point of origin is later found to have removable contamination on its surface or to have contaminated the adjacent environment. The present inventors have discovered that particles of clay that are firmly fixed to the shipping cask surface absorb $^{137}Cs$ when shipping casks are submerged in the spent fuel storage pool during spent fuel loading. Then, during shipping, ion exchange processes occur contaminating moisture on the cask surface and potentially the surrounding environment, i.e., "weeping".

Accordingly, the present invention is of pre- and post-treatment cask loading procedures and kits that significantly diminish the potential for $^{137}Cs$ weeping incidents. The invention has been verified experimentally with various combinations of pre- and post-treatments lowering the level of $^{137}Cs$ retained on the surfaces of metal coupons by as much as a factor of 100.

Mechanisms responsible for $^{60}Co$ retention are different and traditionally are ascribed to the mechanical adhesion of minute Fe—Ni rich particles arising from corrosion in reactor cooling systems. $^{60}Co$ is a trace constituent in these particles and can be released to produce a weeping incident when the particles dissolve or are mechanically abraded from the cask surface. Alternatively, the stainless steel surface oxidation may have sorption sites with the potential for scavenging dissolved $^{60}Co$ as well as some $^{137}Cs$ from cooling pond waters. As expected, the chemical processes that reduced $^{137}Cs$ retention were not as effective at mitigating $^{60}Co$ retention.

The phenomenon discussed herein is described by many descriptive terms. Colloquially, it is described as cask or flask "weeping" (particularly in Japan and North America), or "sweating" or "sweat-out effect" (in Europe). Regulators use phrases such as "removable external radioactive contamination" (U.S. Nuclear Regulatory Commission) or "non-fixed removable radioactive contamination" (U.S. Department of Transportation). The IAEA uses the expression "non-fixed [surface] contamination". Phrases for the phenomenon based upon permutations of keywords including "radioactive", "radionuclide", "surface", "external", "contamination", "excessive", "maximum accepted", "non-fixed", "removable", "reversible", "adsorbed", "ionic", "ion exchange", and even "above-norm", et cetera are found, interchangeably, in the literature.

As the mechanism for the phenomenon has become better understood, an appropriate technical term for the phenomenon describing release of previously "fixed" radionuclides from the surface of a transport package to a "non-fixed, removable" condition may be [radio]nuclide adsorption/desorption or simply nuclide desorption. Nuclide adsorption/desorption, although not consistently used herein, is suggested as a more technically rigorous expression of the phenomenon than those previously and widely used in the literature.

$^{137}Cs$ exists as a positive ion dissolved in the cooling pond water and most shipping cask surfaces will not be completely free of dirt when lowered into the pond. The literature on Cs sorption clearly indicates that clays are far more effective scavengers of cesium than are the metal oxides found on stainless steel surfaces. Compare Dzombak D. A. and Morel F. M. M. (1990) *Surface Complexation Modeling Hydrous Ferric Oxide*. John Wiley and Sons.

with T. Tamura, "Sorption phenomena significant in radioactive waste disposal", in *Underground Waste Management and Environmental Implications*, Vol. Memoir # 18, pp. 318-330, American Association of Petroleum Geologists, Tulsa, Okla. (1972). When a clay site acquires a positive cesium ion the process produces a local neutral electrical charge balance. Once the negatively charged layers of the clay mineral no longer repel each other they are able to come together and capture the cesium ion in a rigid cage made up of the clay mineral lattice. Thus, the release of the Cs from clays is always much slower than its uptake. However, it eventually must take place if a new fluid comes in contact with the clay that differs from the fluid that was the initial Cs source (e.g., the new fluid has less Cs and/or more of other ions, $Na^+$, $Mg^{2+}$, $NH_4^+$, etc., that can also occupy the exchange sites). Once $Cs^+$ is released to surrounding fluids it is no longer "fixed contamination" and resulting in the phenomenon know as "weeping". Although data is presented regarding the behavior of $^{60}Co$, the present invention primarily mitigates $^{137}Cs$ releases. In the spent fuel storage ponds it is thought that $^{60}Co$ occurs largely as a trace constituent in minute particles of Fe—Ni oxides ("CRUD") derived from the corrosion of stainless steels in the reactor cooling system. Removing $^{60}Co$ is a matter of freeing the particles from the cask surface or creating local reducing or acidic conditions that dissolve them. However, Jawarani, et al., supra, suggested an alternate mechanism for $^{60}Co$ retention relating to ion exchange sites that exist in the oxide passivating layers formed on the surface of the stainless steel cask itself. These same mechanisms are also suggested as a means whereby Cs can be retained by the surfaces of clean stainless steel shipping casks. However, an important mechanism has been missed by prior research, namely the retention of Cs in ubiquitous clays, as shown diagramatically in FIG. 1.

Figure 2:
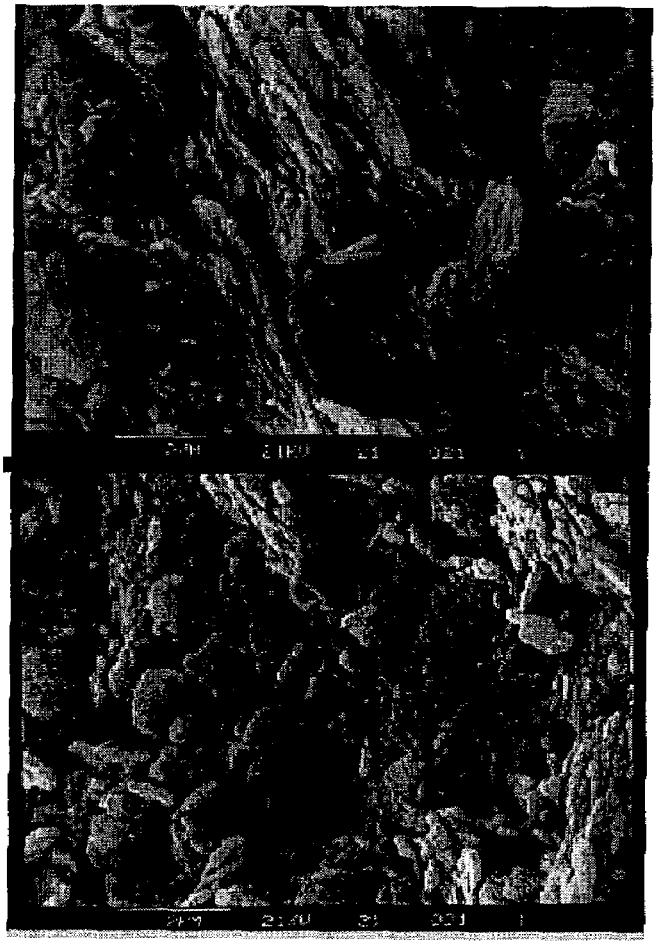
FIG. 2 is a scanning electron photomicrograph of kaolinite clay showing its generally platy or layered texture and extremely fine grain size, both features conducive to causing particles to adhere tightly to the polished metal surface of a shipping cask.

Clays are any of a group of hydrous aluminum silicates with layered, sheet-like structure and a very small particle size. The term "clay" is generally applied to 1) a natural material with plastic properties, 2) particles of very fine size, customarily those defined as particles smaller than two micrometers, and 3) very fine mineral fragments or particles composed mostly of hydrous-layer silicates and aluminosilicates. Kaolinite clay is illustrated in FIG. 2.

Clay minerals are composed essentially of silica and alumina with variable amounts of magnesia and iron accompanying the alumina. In addition, for some clays (not kaolinite) a variety of alkaline or alkaline earth cations are typically found between the layers to maintain overall charge balance along with their various waters of hydration. This chemistry reflects the normal relative abundance of common elements on the earth's surface. Under laboratory (or industrial) conditions a host of rarer elements (such as cesium) can also be placed artificially at various sites in clay mineral lattices.

The essential features of hydrous-layer silicates are continuous two-dimensional tetrahedral sheets of composition $Si_2O_5$, with $SiO_4$ tetrahedrons linked by the sharing of three corners of each tetrahedron to form a hexagonal mesh pattern. The apical oxygen at the fourth corner of the tetrahedrons, which is usually directed normal to the sheet, forms part of an adjacent octahedral sheet in which (metal containing) octahedrons are linked by sharing edges. The junction plane between tetrahedral and octahedral sheets consists of the shared apical oxygen atoms of the tetrahedrons and unshared hydroxyls that lie at the center of each hexagonal ring of tetrahedrons and at the same level as the shared apical oxygen atoms.

TABLE 1

Ions Found in Clays

| Common constituents | | | Occasional constituents | | | Constituents found in interlayer spaces | | |
|---|---|---|---|---|---|---|---|---|
| ion | radius (nm) | $r_c/r_o$ | ion | radius (nm) | $r_c/r_o$ | ion or molecule | radius (nm) | $r_c/r_o$ |
| $O^{2-}$ | 0.135 | — | $Ni^{2+}$ | 0.074 | 0.55 | $Na^+$ | 0.101 | 0.75 |
| $Si^{4+}$ | 0.040 | 0.30 | $Ti^{4+}$ | 0.060 | 0.44 | $K^+$ | 0.134 | 1.00 |
| $Al^{3+}$ | 0.055 | 0.41 | $Zn^{2+}$ | 0.057 | 0.42 | **$Cs^+$** | **0.163** | **1.24** |
| $Fe^{2+}$ | 0.080 | 0.59 | $Mn^{2+}$ | 0.083 | 0.61 | $Ca^{2+}$ | 0.105 | 0.78 |
| $Fe^{3+}$ | 0.067 | 0.54 | $Mn^{3+}$ | 0.072 | 0.53 | $Ba^{2+}$ | 0.140 | 1.03 |
| $Mg^{2+}$ | 0.078 | 0.58 | $Mn^{4+}$ | 0.052 | 0.39 | $Sr^{2+}$ | 0.118 | 0.87 |
| | | | $Li^+$ | 0.076 | 0.56 | $H_2O$ | 0.145 | |
| | | | $Cr^{3+}$ | 0.065 | 0.48 | $NH_4^+$ | 0.143 | |
| | | | $Cu^+$ | 0.095 | 0.70 | | | |

There are two major types for the structural "backbones" of clay minerals called silicate layers. The unit silicate layer formed by aligning one octahedral sheet to one tetrahedral sheet is referred to as a 1:1 silicate layer, and the exposed surface of the octahedral sheet consists of hydroxyls (FIG. 2). In another type, the unit silicate layer consists of one octahedral sheet sandwiched by two tetrahedral sheets that are oriented in opposite directions and is termed a 2:1 silicate layer. Hydrogen bonding such as is illustrated in FIG. 1 does not exist between the layers of a 2:1 because the octahedral sheet is obscured on both sides by the (silica-rich) tetrahedral sheets. However, in 2:1 clays it is common for the layers, themselves, to be deficient in positive (metal) ions and acquire a net negative charge. To achieve charge neutrality positive ions (typically $Na^+$, $K^+$, $Ca^{2+}$ and $Mg^{2+}$) are located between the layers. Unlike metal ions in the octahedral sheets these ions are relatively accessible to the environment and may be exchanged by diffusion out of the open spaces between the layers. This accounts for the relatively high exchange capacity of 2:1 clays relative to kaolinite—which at least formally has no net negative layer charge.

Figure 3:
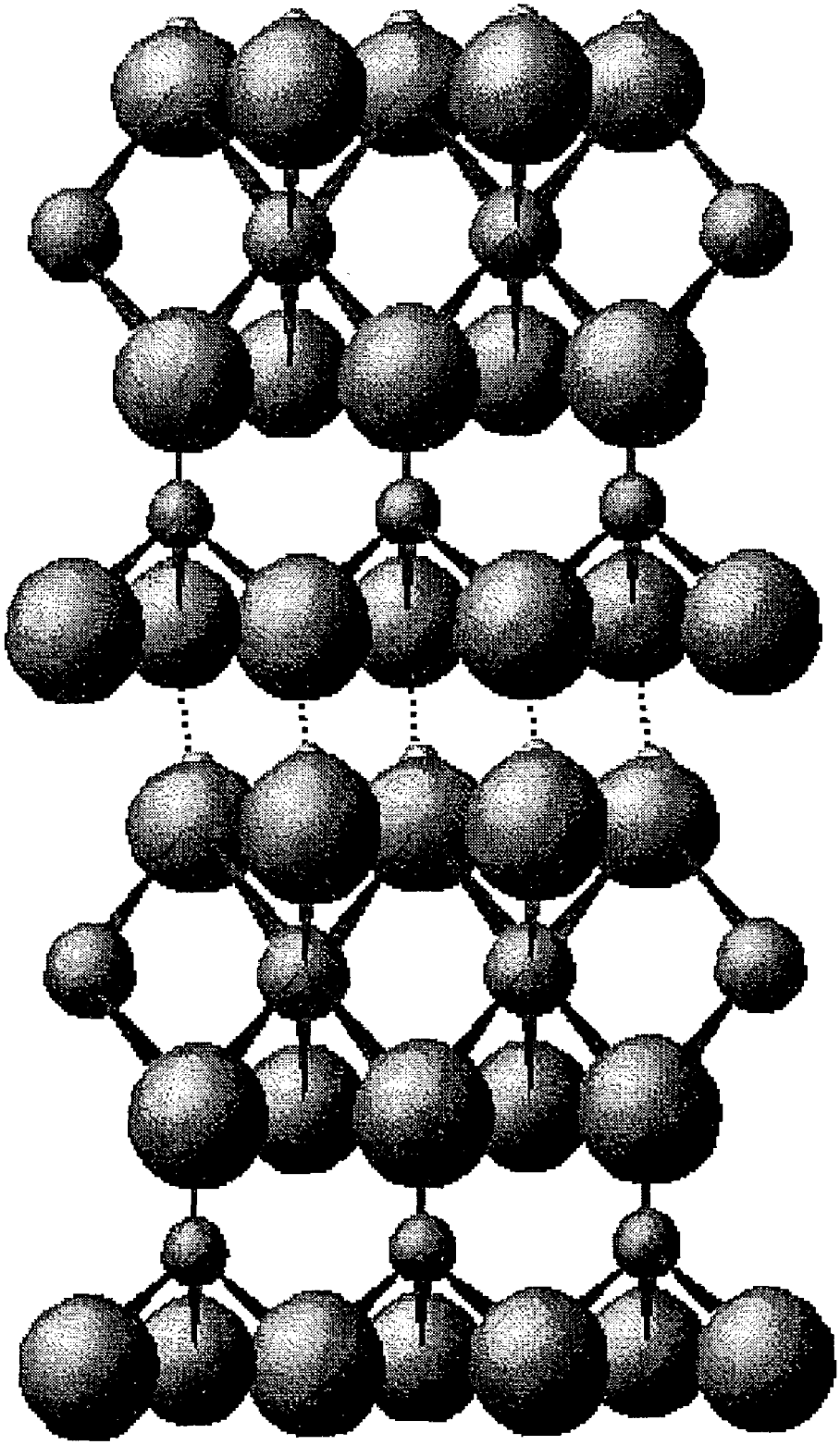
FIG. 3 illustrates the basic structure of the clay mineral, kaolinite.

Referring to the kaolinite structure of FIG. 3, in descending size, the ions represented are $O_2$, $Al^{3+}$, $Si^{4+}$, and $H^+$. The structure illustrated is 0.7 nm thick from the bottom oxygen to the third oxygen layer and extends 10 nm and more in the other two directions. This three-dimensional structure is a clay "micelle". The kaolinite mineral is made up of many micelles piled one atop the other. Cesium ions can bond between the micelles of kaolinite or within the structure of other types of clay. This structure is described as a 1:1 clay since one layer is characterized by having a predominance of Si and the other a predominance of metal cations (Al in this case). In 2:1 clay minerals—like montmorillonite and illite—there is still one metal-rich layer (now with Mg and Fe in addition to Al) but it is now sandwiched between a Si-rich layers so that both the top and bottom surfaces of the layer both look like the lower surface of the kaolin structure illustrated above.

A final complication with 2:1 clays occurs when the negative charge on the layers becomes great enough that there is a high cation residency in the interlayer spaces. In this instance the attraction between the layers and the interlayer cations may also become large enough that the hydration waters normally accompanying the interlayer cations are excluded. Loss of these waters allows the layers to come closer together, after which only a small fraction of the interlayer cations have free access to the clay particle surface—and the exchange capacity is significantly reduced. An ideal formula for a 1:1 clay is provided by the mineral kaolinite, $2SiO_2Al_2O_3\ 2H_2O$, while a typical 2:1 clay such as montmorillonite has the idealized formula: $(Na, K, Mg, Ca)(Al, Mg, Fe)_6(Si_4O_{10})_3(OH)_6\text{-}nH_2O$.

All types of clay minerals have been reported in soils: kaolinite dominates in regions with high rainfall and a large amount of biologic activity provides organic acids which keep soil water pH values low. In drier climates, or where weathering is less advanced, it is likely that 2:1 clay minerals will predominate. However, many exceptions to these generalities exist. What is certain is that some sort of clay will be found wherever a soil has developed, where sediments have collected, or where rocks are being actively weathered. Because of their ubiquitous distribution, clays will be a component of road grime deposited on a shipping cask at virtually any location.

Ion-exchange capacity is a measure of the ability of an insoluble material to undergo displacement of ions previously attached and loosely incorporated into its structure by similarly charged ions present in the surrounding solution. Zeolite minerals used in water softening, for example, have a large capacity to exchange sodium ions ($Na^+$) for calcium ions ($Ca^{2+}$) of hard water. High cation-exchange capacities are characteristic of some clay minerals as well as numerous other natural and synthetic substances.

Recognition of ion-exchange processes antedates Arrhenius, who formulated the ionic theory. In 1850, nine years before Arrhenius was born, agriculturist Sir H. S. M. Thompson and chemist J. T. Way described the phenomenon of ion exchange as it occurs in soils. Way addressed the question of how soluble fertilizers like potassium chloride were retained by soils even after heavy rains. A box with a hole in the bottom, was filled with soil, a solution of potassium chloride was poured over the soil, the liquid that flowed out of the bottom collected. The soil was then washed with rainwater and the water collected analyzed, from both the solution and the rainwater. The water turned out to contain all of the chloride that had been originally added but none of the potassium; the potassium had been replaced by chemically equivalent amounts of magnesium and calcium. The potassium could be regained by washing the soil with a solution containing a high concentration of calcium chloride (which pushed the equilibrium in the opposite direction). The process has become universally known as "ion exchange".

Figure 4:
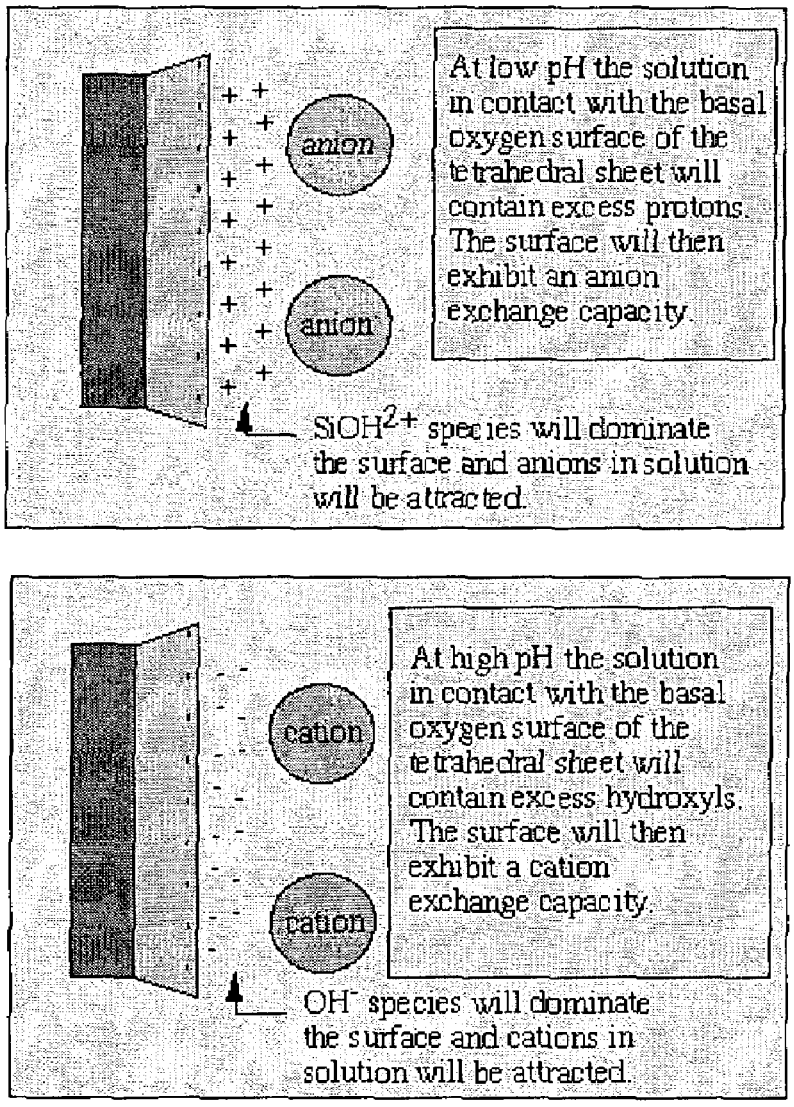
FIG. 4 is an illustration that, with solution pH below the pH at the point-of-zero-charge, e.g., $pH_{PZC}$ (rainwater on a stainless steel oxide), the surface has a positive charge and an anion (−) exchange capacity (top), and with solution pH above $pH_{PZC}$ (rainwater on a clay), the surface has a negative charge and a cation (+) exchange capacity (bottom)

Soil is able to bind positive ions (like $K^+$ and $Ca^{2+}$) because in large part it contains clay. The three basic kinds of sites where metal ions may bind are discussed in roughly the order of increasing importance. The quasi-infinite array of exposed oxygen atoms on the surfaces of the clay sheets also constitutes an infinite array of negative charges with the compensating positive charges displaced to the interior of the clay mineral layers. The exposed negatively charged nodes have a slight tendency to attract hydrogen ions (or to a far lesser extent other metals) and thus the surface acquires a net charge depending on the fraction of these sites that are associated with hydrogen ions. That is, the surface charge changes with solution pH, a slight positive charge exists at low pH and a positive charge at high pH. Where the surface has a slight negative charge there is, obviously, a slight tendency for other cations to be attracted to the surface (FIG. 4).

Two more numerous types of exchange sites for metal ions arise from imperfections in the clay crystal lattice. Clearly, the aluminosilicate sheets must eventually end at which point the exposed oxygens are no longer surrounded by a full complement of metal ions (FIG. 4, right $K^+$ ion). This leaves oxygens with unsatisfied bonding capacity (in contrast to just comprising local negative charge centers as described above). This unsatisfied bonding capacity is satisfied by binding to ions from adjacent solutions. Hydrogen ion is preferred but at high pH this can be removed and other metal ions can be sorbed. In this regard it is similar to the first type of site just described. Finally, it is relevant to point out that the face and edge sites on clays are similar to those encountered on the surfaces of the oxide coatings that make up the passivating layers on stainless steel.

Where the two types of sites just described predominate ion exchange processes are tied to the abundance of surface hydroxyls. An excess of surface hydroxyls will occur at low pH where there is an excess of hydrogen ions in solution. In this setting a net positive surface charge exists and anion sorption is favored. The opposite is true at high pH values where cation sorption is favored. The "point of zero charge" (PZC) is a useful concept that describes when the transition from anion sorber to cation sorber exists for different compounds. For stainless steel oxide coatings the PZC is about pH 8. So, at pH<8 (~water in a spent fuel pool; rain [pH~5]), the stainless steel oxide surface of a package is positive and therefore attracts anions (–), not $Cs^-$ or $Co^{2+}$. Thus, if the classical description of pH 5.6 pool water (Jawarani et al., 1993) is universally correct this provides another reason why sorption should not be the mechanism responsible for loading shipping cask surfaces with either of the main radionuclides implicated in weeping. Paints, such as those that contain $TiO_2$ have a PZC at pH~4-5, and clays such as kaolinite have a PZC at pH~2-4, implying that cations might be attracted to the edge sites of either a painted or clay-covered surface. Finally, it must be re-emphasized that that they would also still be attracted to the (usually more numerous) sites formed from substituting a lower-valent cation for one with a higher charge.

Figure 5:
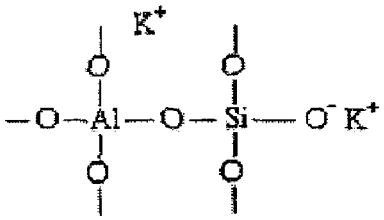

It is also common in clays for sites normally occupied by higher charged ions to be replaced with ions of similar size (Table 1) but having a lower charge. In 2:1 clays this phenomena is prevalent and accounts for almost all of the overall ion exchange capacity of the material. Often 2:1 clays are abundant enough in soils that this type of site completely overshadows all the other kinds of ion exchange sites that are present. In addition, the phenomena are not restricted to 2:1 clays. In the example below (typical of kaolinite) a silicon atom is replaced by an aluminum atom and a charge deficiency develops that must be compensated for by including an extra cation ($K^+$) near by (see top $K^+$ ion, below, see also FIG. 5).

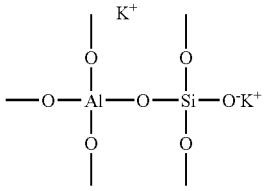

Unlike the first two type's sites the third type of site is not sensitive to pH changes. If a charge deficiency arises from substituting a lower valence cation for a higher valence cation deep inside the crystal structure no single oxygen atom is greatly affected. The electrostatic field on the surface of the clay layer is, thus, relatively diffuse and the bounding of the counter-cation is only marginally selective. In particular, there is no special preference for sorbing hydrogen ions over metal ions since there is insufficient local charge balance to actually form a discrete hydroxyl unit. In this setting sorption of a particular metal depends only weakly on solution pH. This accounts for the lack of a pH dependence for sorption of metal ions on sites of this type.

One final challenge is to explain why 2:1 clays are so much more important in determining the fate of $^{137}CS$ than for $^{60}Co$. Partly this arises from the fact that most of the cobalt is tied up in CRUD and not in a dissolved form where it can participate in ion exchange reactions. However, there is a second factor that may be equally important since thermodynamics constraints dictate that there must always be at least some dissolved Co. The reason was alluded to earlier and is related to relatively sizes of the two ions. Hydrated cobalt ions are about the same size as the other common interlayer cations and more or less have to compete for sorption sites based on relative abundance. $Cs^+$ ions, on the other hand, are not strongly hydrated and just happen to fit perfectly into the hexagonal cavities formed in the silica sheets facing outward on either side of the 2:1 layer surfaces. Other ions such as $K^+$, $Rb^+$ and $NH_4^+$ also satisfy these criteria, though not quite as well as $Cs^+$. This makes cesium sorption an energetically favorable process. Once it is sorbed the two clay layers may approach each other and trap the Cs in the cavity (FIG. 1). Thus, while cobalt is not strongly sorbed, and can be readily washed out, the opposite is true of cesium.

The present inventors believe that an ion exchange mechanism involving clays is responsible in large measure for the cesium contamination that is mobilized during transit of spent fuel packages: it is hypothesized that cesium from spent fuel storage pool water is initially sorbed by clays that are strongly attached to the package surface because of the platy nature of the clay mineral crystals. This bond should be strong enough that most of the clay, and cesium, would not be removed by normal cleaning or swiping operations; it is "fixed contamination". Subsequently, during transport or long-term storage of the package, cations present in some aqueous solutions coming in contact with the package surface undergo ion exchange reactions with cesium ions in the clays affixed to the cask surface. This mobilizes the cesium and it becomes "non-fixed contamination" and can lead to weeping incidents. Ultimately, it is equilibrium thermodynamics which describes the end state of this process in various environments:

Suppose one has a clay (X) that is in equilibrium with a fluid. The fluid contains both dissolved cesium ($Cs^+$) and sodium ($Na^+$). As a consequence, both ions will be sorbed onto the clay: Na<X and Cs<X. The partitioning of the two ions onto the solid can be described by the reaction:

$$Cs^+ + Na{<}X \leftrightarrow Na^+ + Cs{<}X \quad (1)$$

For this chemical reaction, it is possible to write an equilibrium constant, where the [ ] notation represents the concentration of the various components: for example, grams of Cs per gram of clay, or grams of Cs per ml of fluid.

$$\frac{[Na^+] \times [Cs < X]}{[Na < X] \times [Cs^+]} = K_x \quad (2)$$

If this mathematical identity is not satisfied when the fluid and clay initially come in contact, exchange reactions, per equation (1), will take place until the mathematical equality is satisfied.

For example, assume rain falls onto a cask on which cesium is bound to clay X.

$$\frac{[Na^+] \times [Cs < X]}{[Na < X] \times [0]} = K_x \quad (3)$$

where [Cs+]=0 in equation (2) (no cesium in rainwater).

So, to satisfy the chemical equilibrium, [Cs<X] exchanges ("weeps") off the clay into solution ([Cs+]) with the rainwater. (There may also be an exchange of sodium.)

Also, assume that a second clay (Y) is introduced into the system and is also in contact with the same solution. Although clay Y may contain no Cs initially (i.e., [Cs<Y] =0), it will ionically exchange enough Cs so that the following equality is satisfied:

$$\frac{[Na^+] \times [Cs < Y]}{[Na < Y] \times [Cs^+]} = K_y \quad (4)$$

Dividing one equation by the other it is possible to eliminate the solution concentrations from consideration:

$$\frac{[Na < Y] \times [Cs < X]}{[Na < X] \times [Cs < Y]} = \frac{K_x}{K_y} \quad (5)$$

If this second clay (or other sorbing material) is not firmly fixed to the cask surfaces, then partitioning of the Cs onto this material from both clay X and the rainwater will produce a weeping incident.

The same types of equilibria would be achieved for each of the cation pairs in the system; the net effect is thus complex and difficult to predict in detail. However, the literature contains general values for the various equilibrium constants, so basic modeling of these processes, at least for montmorillonite-type clays, can be initiated (P. Fletcher, et al., "The chemical modeling of clay/electrolyte interactions for montmorillonite", *Clay Mineral* 24, pp. 375-391 (1989)).

To summarize, a coating of clay inherently exists on spent-fuel package surfaces. Cesium has a high affinity to clay; $Cs^+$ is ionically bonded between layers of clay. Fixed $Cs^+$ in the clay layers manifests as non-fixed contamination ("weeps") via an ion exchange process when exposed to solutions containing preferential cations.

Cs more readily adsorbs to cask surfaces than Co, although Co activity in pool is generally greater than Cs activity, i.e.:

$$[Cs]_{cask}/[Cs]_{pool} >> [Co]_{cask}/[Co]_{pool}$$

Co can effectively be removed by "mechanical" washing techniques (albeit, most "weeping" incidents are Co related). Some Cs will always be retained on cask surface, even after thorough washing of cask. Thus, there is always some potential for a Cs-related "weeping" incident.

An experimental plan was developed to: 1) confirm the physical/chemical process of cesium ion exchange as it occurs on spent fuel packages—this was confirmed; and 2) select an optimum "wash" for mitigation of Cs weeping.

The ion-exchange mechanism was demonstrated for Cs adsorption/removal. There was no pH effect on Cs uptake, which supports the ion-exchange hypothesis. Soiling the surface resulted in a marked increase in $^{137}Cs$ retention (compared to a freshly washed—"as received" surface), but produced only a small increment in the amount of $^{60}Co$ retained.

A factor of >100 reduction in absorbed radioactive Cs was achieved. Optimal Cs mitigation was achieved via a $Cs_2SO_4$ (cesium sulfate) pre-wash followed with multiple water or cation post-washes. An aqueous solution is preferred to enhance ion exchange, but other solutions may be feasible. Other cations of similar size and valence that may work approximately as well as cesium include cations of rubidium, silver, and thalium, but these have significant disadvantages in terms of cost, toxicity, and/or reactivity. Additionally, other salts of cesium may be employed, such as cesium chloride, cesium nitrate, and cesium acetate.

Note that although the present invention is particularly useful for casks used for transporting spent fuel, it applies equally to any radioactive material containing package as to which removal of radioactive Cs from the surface is desired and, for that matter, from any surface contaminated with radioactive Cs. Furthermore, although the invention is particularly useful as to the outside of casks, it can also be employed to remove radioactive Cs from a cask interior after transport of radioactive substances.

Pre-treatment with substantially non-radioactive Cs is the most effective process for minimizing the uptake of radioactive Cs on metal surfaces and markedly decreases retention of Cs. The uptake of Cs is correlated with the presence of road grime. None of the pre-treatments had an impact on Co uptake. Co uptake involves a different mechanism and is unrelated to the presence of road grime. Post-washing removes some Co, but the amount is not related to the chemistry of the wash fluids or the presence of road grime. Preferred concentrations of Cs, K, and ammonia pre-wash solutions are greater than approximately 0.1 molar up to the saturation limit of the salt(s) being used as the source of the cation(s).

Tap water, $K^+$, and $NH_4^+$ post-wash solutions work well for Cs removal for all pre-treatment conditions. In contrast to pre-treatment, post-washing with Cs is least effective apparently due to a reduced driving force for ion exchange. This trend holds for coupons pre-treated with tap water, $K^+$, $NH_4^+$ or with $Cs^+$. Preferred concentrations of non-radioactive Cs post-wash solutions are as low as can be economically achieved and preferably less than approximately 0.001 molar. Preferred concentrations of $NH_4^+$ and $K^+$ post-wash solutions are equal to or greater than approximately 0.1 molar.

Tap water was the only pre-treatment that was not effective at eliminating retained $^{137}Cs$ for samples that were not exposed to simulated road grime, but it was the most effective agent in diminishing retention of Co. For soiled samples, the beneficial effect of a tap-water pre-wash on Co retention seems to disappear. For soiled samples, there is a beneficial effect of a Cs pre-wash. A $NH_4F$ pre-treatment to attack clay on coupon surface was ineffective.

The process for mitigating cesium retention on metal coupons described below has direct, beneficial application to the loading of spent fuel casks: the process 1) will be effective in mitigating the retention of Cs on cask surfaces, and 2) will reduce the number of weeping incidents related to Cs contamination.

The following kit components are preferred to accomplish the process of the invention: 1) pre-mixed solutions of $K^+$, $NH_4^+$ and/or non-radioactive $Cs^+$; 2) Cs, K and ammonium sulfate salts with instruction on preparing appropriate concentrated washes; 3) a pre-made absorbent wrap containing salts or solutions of any/all of the above salts with or without the option of providing additional water or solutions that perform the function of either a pre or post rinse of the canister surface or provide the moisture needed to wet the pad and activate the components contained therein; (4) absorbent wipes that perform similarly to the wraps described above; and (5) removable absorbent gels, paints, "peels", or other media for surface application containing the above mentioned components. Kit instructions may stipulate several steps detailing both the pretreatment of the shipping casks (or other equipment that may potentially become contaminated due to immersion in contaminated waters) prior to submersion as well as their post-treatment after immersion. Kit components employed at these two stages may be quite similar or radically different in composition and design.

INDUSTRIAL APPLICABILITY

The invention is further illustrated by the following non-limiting examples.

The objective of the testing described below was to: 1) Confirm the cesium ion exchange weeping hypothesis, namely, $Cs^+$ fixed on a spent fuel package surface becomes non-fixed when exposed to water with ions which ionically exchange with $Cs^+$ in clay layers; and 2) devise and demonstrate a procedure (a "wash", pre-pool and/or post-pool) to mitigate or prevent the occurrence of unfixed $Cs^+$ contamination on spent-fuel package surfaces.

The following overall plan was followed:

1) Immerse (~15-20) stainless steel coupons (the surrogate package surface) into water containing the radioactive tracer isotope $^{137}Cs$ (the surrogate spent fuel pool). Soak as f(time) and f(pH) [f(pH) tests to demonstrate that Cs bonding is not an adsorption mechanism]). Coupons shall be of a type of stainless steel used in packages and shall have a surface finish(es) typical of packages. (The amount of Cs "bonded" to stainless steel surfaces after exposure to solution will be measured by the difference between the Cs in the original solution minus the amount of cesium remaining in the solution after exposure to the coupons.)

2) Remove stainless steel coupons and rinse with deionized $H_2O$ and "tap" water. These coupons shall be swiped and scintillation counted (both swipe and coupon) for $^{137}Cs$. (Ideally, most of the Cs will be fixed to the coupons.)

3) Wash a subset of the coupons with solutions containing candidate cations that may ionically exchange with $Cs^+$ cations (e.g., $Na^+$, $Li^+$, $K^+$, $Rb^+$, $NH_3^+$, "rain water", others). ("Pre-immersion washes" containing ions, possibly including non-radioactive Cs that may preferentially occupy "Cs sites" may also be applied to the coupons prior to step 1).

4) Analyze residue solutions from step 3) after washing stainless steel coupons to determine amount of $^{137}Cs$ removed. (Repeated washes are expected to be most effective in removing cesium.)

5) Assess the impact of the pH of the post-immersion wash solution on the release of $^{137}Cs$ and $^{60}Co$.

6) Interpret experimental results to: i) confirm the ion exchange mechanism, and ii) to describe the physical/chemical process of ion exchange as it occurs on spent fuel packages.

In additional research directed at finding effective post-wash solutions, road grime (in the absence of coupons) was loaded with cesium and the soluble salts were then rinsed out. The Cs-loaded road grime was then exposed to various chemical agents and their effectiveness judged by monitoring the Cs buildup in the coexisting solution.

A number of identical coupons were machined to fit conveniently into the automated gamma-ray counter that were 6.3 cm long, 0.75 cm wide and 0.25 cm thick. Prior to being cut to size the surfaces were finished to be representative of what might exist on a shipping canister (3.2 μm). Subsequent to machining all of the coupons were washed with detergent to remove machine oils and then air-dried. Half of the samples were then exposed to road grime in the following manner. The undercarriage of an automobile was lightly abraded with a wire brush and the spalled material was collected. A thick suspension of this was then prepared using deionized water. The coupons were submersed in the slurry and let stand over the weekend while the slurry dried on the coupon surfaces. Next, the coupons were rinsed under the tap while being lightly abraded with a test tube brush until they appeared to be clean. No detergent was used in cleaning the coupons during this washing. These "soiled" coupons were then air dried.

Pre-treatment was carried out using 0.1 M solutions of $Cs_2SO_4$, $(NH_4)_2SO_4$ and $K_2SO_4$. It was thought desirable to keep the counter-anion the same for the three pretreatment fluids. However, selection of sulfate was arbitrary and merely reflected the inventory of Cs salts on hand at the time the pretreatment was carried out. Four clean coupons and four soiled coupons were then immersed in each of the three salt solutions, and a final four of both designations ("clean" and "soiled") were left untreated (i.e., merely washed with "tap" water prior to initiating the tests) to act as controls. Pretreatment consisted of immersing the coupon in the appropriate fluid and then thoroughly rinsing the coupon with deionized water and letting it air dry. These activities produced a 2×4 matrix of test coupons (soiled or unsoiled X four pre-treatments) that were then exposed to fluids containing both radioactive Cs and Co.

Each batch of four coupons was then placed (together) in a 25 ml test tubes containing tap water spiked with 10 μCi/L $^{137}$Cs and 25 μCi/L $^{60}$Co and allowed to equilibrate for about a day. Coupons were then removed, individually cleaned of adhering droplets test fluid by a quick rinse with deionized water and dried again prior to counting. Thus, for each pretreatment four replicate measurements were made of the amount of surface contamination retained by the coupons. Average surface contamination levels for each type of pretreatment along with the standard deviation of the four measurements are given in Table 2.

TABLE 2

Results of initial loading after different pretreatments: Average surface contamination on four coupons ($10^{-3}$ μCi) for each pretreatment group and standard deviations for each group.

| | Cation & surface condition | | | |
|---|---|---|---|---|
| Pre-Treatment | Cs, clean | Cs, soiled | Co, clean | Co, soiled |
| Tap Water | 2.44 ± 0.28 | 42.9 ± 5.6 | 1.77 ± 1.18 | 2.61 ± 0.41 |
| 0.2 M $Cs^+$ | 0.40 ± 0.46 | 4.24 ± 0.37 | 2.43 ± 0.35 | 2.78 ± 0.30 |
| 0.2 M $K^+$ | 3.21 ± 0.38 | 11.2 ± 1.7 | 2.16 ± 0.20 | 2.72 ± 0.16 |
| 0.2 M $NH_4^+$ | 2.99 ± 0.36 | 14.4 ± 2.8 | 2.01 ± 0.18 | 2.62 ± 0.14 |

The next step in the processing was to investigate whether there might be a difference in the ability of various fluids to remove radioactivity that had already become affixed to coupon surfaces. In these tests, for each of the four pretreatment groups, one coupon was placed in each of (radionuclide-free) pretreatment fluids that was used to initially precondition the coupons. Samples were again allowed to equilibrate with the fluid over the weekend and then removed, cleaned, and counted in the manner described earlier.

Tables 3-6 give residual surface loadings after this rinse process for respectively: residual $^{137}$Cs on unsoiled coupons, residual $^{137}$CS on soiled coupons, residual $^{60}$Co on unsoiled coupons and residual $^{60}$Co on soiled coupons. Results for each coupon are listed as follows, the residual activity prior to post-washing (upper left), the residual activity after post washing (upper right), and the percentage reduction resulting from the post-wash of that particular coupon. Parenthetically, for each row the upper left values in the boxes represents the numbers that were used in calculating the averages and standard deviations presented in Table 2.

TABLE 3

$^{137}$Cs Retention and release by unpainted coupons that were not exposed to road grime: results are activity ($10^{-3}$ μCi) remaining on the coupon surfaces.

| | Post-Treatment | | | |
|---|---|---|---|---|
| Pre-Treatment | Tap Water | 0.2 M $Cs^+$ | 0.2 M $K^+$ | 0.2 M $NH_4^+$ |
| Tap Water | 2.4 to N.D., ~100% removed | 2.6 to 1.7, 35% removed | 2.1 to N.D., ~100% removed | 2.7 to 1.1, 59% removed |
| 0.2 M $Cs^+$ | N.D. | 0.72 to 0.20, 72% removed | N.D. | 0.87 to N.D., ~100% removed |
| 0.2 M $K^+$ | 2.8 to 0.30, 89% removed | 3.7 to 2.4, 35% removed | 3.2 to 1.1, 66% removed | 3.3 to 1.5, 55% removed |

TABLE 3-continued $^{137}$Cs Retention and release by unpainted coupons that were not exposed to road grime: results are activity ($10^{-3}$ μCi) remaining on the coupon surfaces.

| | Post-Treatment | | | |
|---|---|---|---|---|
| Pre-Treatment | Tap Water | 0.2 M $Cs^+$ | 0.2 M $K^+$ | 0.2 M $NH_4^+$ |
| 0.2 M $NH_4^+$ | 2.8 to 0.39, 87% removed | 2.8 to 2.0, 29% removed | 2.8 to 1.3, 54% removal | 3.5 to 1.5, 57% removal |

N.D. not detectable

TABLE 4

$^{137}$Cs Retention and release by unpainted coupons that were exposed to road grime: results are activity ($10^{-3}$ μCi) remaining on the coupon surfaces.

| | Post-Treatment | | | |
|---|---|---|---|---|
| Pre-Treatment | Tap Water | 0.2 M $Cs^+$ | 0.2 M $K^+$ | 0.2 M $NH_4^+$ |
| Tap Water | 47 to 17, 64% removal | 39 to 32, 18% removal | 37 to 18, 51% removal | 49 to 25, 49% removal |
| 0.2 M $Cs^+$ | 4.2 to 0.56, 87% removal | 4.0 to 1.3, 68% removal | 4.8 to 0.41, 91% removal | 4.0 to 0.53, 87% removal |
| 0.2 M $K^+$ | 12 to 3.2, 73% removal | 13 to 8.3, 36% removal | 8.9 to 1.9, 79% removal | 10 to 5.3, 47% removal |
| 0.2 M $NH_4^+$ | 13 to 3.6, 72% removal | 12 to 6.5, 46% removal | 16 to 4.8, 70% removal | 18 to 2.3, 82% removal |

TABLE 5

$^{60}$Co Retention and release by unpainted coupons that were not exposed to road grime: results are activity ($10^{-3}$ μCi) remaining on the coupon surfaces.

| | Post-Treatment | | | |
|---|---|---|---|---|
| Pre-Treatment | Tap Water | 0.2 M $Cs^+$ | 0.2 M $K^+$ | 0.2 M $NH_4^+$ |
| Tap Water | 2.4 to 1.7, 29% removal | 2.5 to 1.5, 40% removal | 2.2 to 1.1, 50% removal | N.D. |
| 0.2 M $Cs^+$ | 2.9 to 1.8, 38% removal | 2.1 to 1.3, 38% removal | 2.5 to 1.5, 40% removal | 2.3 to 1.5, 35% removal |
| 0.2 M $K^+$ | 2.3 to 1.5, 35% removal | 2.0 to 1.3, 35% removal | 2.4 to 1.5, 38% removal | 1.9 to 1.3, 32% removal |
| 0.2 M $NH_4^+$ | 2.1 to 1.4, 33% removal | 1.8 to 1.3, 28% removal | 2.2 to 1.3, 41% removal | 2.0 to 1.3, 35% removal |

TABLE 6

$^{60}$Co Retention and release by unpainted coupons that were exposed to road grime: results are activity ($10^{-3}$ μCi) of remaining on the coupon surfaces.

| | Post-Treatment | | | |
|---|---|---|---|---|
| Pre-Treatment | Tap Water | 0.2 M $Cs^+$ | 0.2 M $K^+$ | 0.2 M $NH_4^+$ |
| Tap Water | 2.9 to 1.7, 39% removal | 2.8 to 1.4, 50% removal | 2.9 to 1.2, 59% removal | 2.0 to 1.1, 45% removal |
| 0.2 M $Cs^+$ | 2.7 to 1.5, 44% removal | 3.1 to 1.5, 52% removal | 2.8 to 1.2, 57% removal | 2.4 to 1.4, 42% removal |
| 0.2 M $K^+$ | 2.7 to 1.7, 37% removal | 3.0 to 1.6, 47% removal | 2.7 to 1.1, 59% removal | 2.5 to 1.2, 52% removal |
| 0.2 M $NH_4^+$ | 2.6 to 1.6, 38% removal | 2.5 to 1.2, 52% removal | 2.6 to 1.0, 62% removal | 2.8 to 1.4, 50% removal |

Table 2 (results of initial loading experiments) illustrates the importance of road grime as a sink for cesium uptake and that the behaviors of Cs and Co in the presence of road grime are distinctly different. The particular affinity of clays, particularly illitic clays, for cesium has been known for some time (Tamura, 1972) and X-ray diffraction studies reveal the presence of minor amounts of illite, kaolinite and chlorite (no smectite) as well as larger proportions of quartz, calcite and various feldspars. The fact that the cobalt content of soiled coupons are only marginally greater than that of unsoiled coupons is consistent with the fact that the inter-layer exchange sites on clays do not have a strong affinity for this element (Fletcher et al., supra). The behavior of Co on both sites is probably ascribable to the interactions with the metal oxide surfaces, as described by Jawarani et al., supra. The loading of metal coupons that were not exposed to road grime but still retained cesium can also be ascribed to such interactions.

The other feature that is clearly illustrated by Table 2 is the effectiveness of pre-exposing coupons to ions likely to block Cs sorption sites prior to placing them into the tap water spiked with $^{137}Cs$. Where clays are involved ("Cs, soiled", column 3, Table 2) the effect is particularly noticeable, although a smaller benefit can also be obtained using surrogates for Cs with similar ionic size and charge ($K^+$, $NH_4^+$). It is worth noting that Jawarani et al., 1993, reports a similar effect using divalent $Ba^{2+}$, an ion that is almost the same size as $K^+$. In the case of unsoiled coupons only a pre-treatment with (non-radioactive) cesium seems to be effective at inhibiting the uptake of $^{137}Cs$. It is possible that there is something about metal-oxide sites that have a unique affinity for Cs. Alternatively, even "clean" coupons would have had some exposure to dust and may have acquired a small amount of clay contamination. Because just a trace of clay may be present it is possible that only the large effect of resulting from a Cs pretreatment actually produces a detectable difference.

Interpreting the impact of different post-immersion washings is complicated by the fact that coupons were loaded with very different amounts of $^{137}Cs$ and $^{90}Co$. Tables 3-6 separately compare the effects of post-washing for the two radionuclides and the two surface preparations. For $^{137}Cs$ on clean coupons (Table 3) it is apparent that tap water is better than any of the salt solutions, and that solutions laced with non-radioactive Cs are particularly ineffective at removing sorbed $^{137}Cs$. In the presence of Cs-spiked removal solutions the samples that were pre-washed with Cs clearly released a higher percentage of their Cs than those that received other pretreatments. This same removal pattern is evident for $^{137}Cs$ on soiled samples. For $^{60}Co$ the trends are less obvious but there is a slight trend for the K-spiked solutions to work best and tap water is, marginally, the poorest performer.

Figure 6:
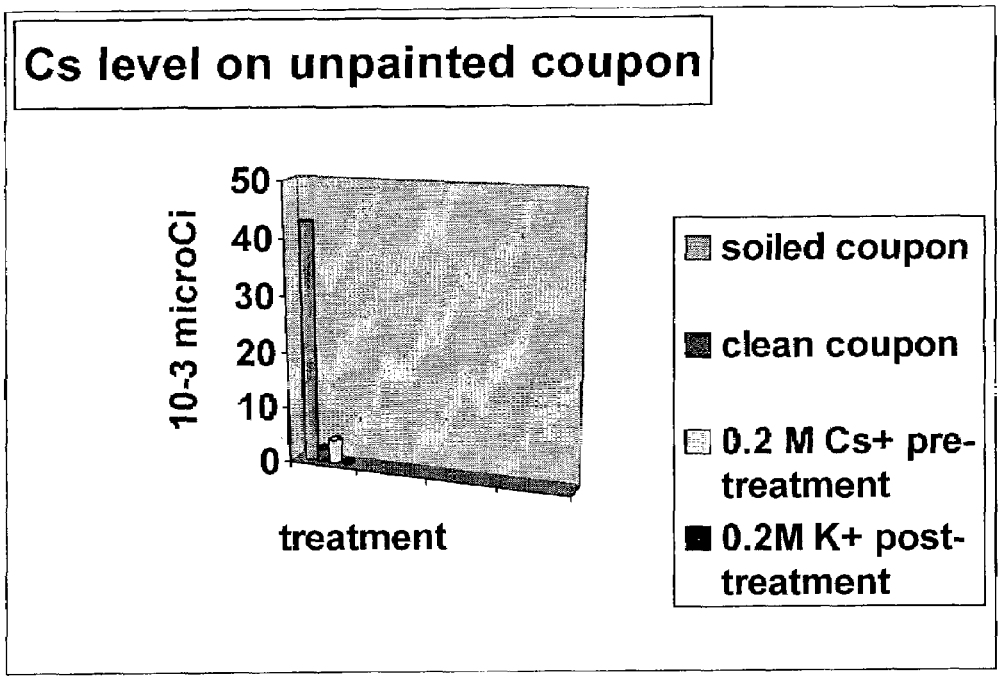
FIG. 6 is a graph of reduction in Cs contamination on an unpainted, soiled stainless steel coupon by treatment with a $Cs^+$ pre-wash and a $K^+$ post-wash according to the invention.

To summarize, if the metal surface is free from road grime only small amounts of Cs are likely to be sorbed and most of this can be removed with a simple tap water rinse without pretreating with non-radioactive Cs. Soiled surfaces pick up significantly more Cs and require both a pretreatment (ideally with non-radioactive Cs) as well as a post-wash to get the activities down to the range observed for unsoiled samples. Soiled coupons without Cs pretreatment acquired an average $^{137}Cs$ loading of $42.9\times10^{-3}$ μCi. If a coupon is pretreated with non-radioactive Cs and post-washed with tap water the residual coupon had $0.56\times10^{-3}$ μCi (Table 4). Or, if post-washed with the $K^+$ solution, a residual activity of $0.41\times10^{-3}$ μCi. This suggests a methodology for achieving overall decontamination factors of about 76 to 105 (FIG. 6). Clean coupons that had been pre-treated with Cs had, on average, less $^{137}Cs$ than was obtained by the complete treatment of soiled coupons. In a number of cases the simple washing of an unsoiled sample resulted in contamination that was below our detection limit. Significantly less cobalt was removed by these approaches with decontamination factors generally between a third and two thirds.

FIG. 6 shows reduction in Cs contamination on an unpainted, soiled stainless steel coupon by treatment with a Cs+ pre-wash and a K+ post-wash. The total reduction in the Cs level on the surface of the coupon with both the pre- and post-wash is approximately a factor of 105.

As research progressed a question was raised regarding the effect of coupon surface preparation; in particular whether painted surfaces would respond similarly. To address this a number of coupons were painted in the appropriate manner and a smaller experimental matrix was devised for comparison (a number of combinations were deleted based on the lessons already learned on the bare metal surface coupons). In this case "clean" refers to as-received painted coupons and "soiled" refers to samples that were immersed in the same batch of road grime slurry (rewetted) as was used the first time. After pretreatment, the samples were then exposed to radionuclide doped tap water as before, then rinsed, dried and counted (Table 7). Because it was expected that the loading of grime (and hence radionuclides) might not be reproducible a few bare metal coupons were inserted as "controls" in this matrix as well, and are compared with their analogues from the previous test sequence. This proved correct and this suite of samples did not retain nearly as much grime (even on unpainted metal finish samples) as had adhered to first set of coupons.

TABLE 7

Comparison of initial loadings onto painted and unpainted coupons.

| Finish | Exposure | Pre-treatment | $^{60}Co$ Retention ($10^{-3}$ μCi) | $^{137}Cs$ Retention ($10^{-3}$ μCi) |
|---|---|---|---|---|
| Metal/ | Fresh | Tap Water | 2.51 | 2.64 |
| Painted | | | 0.96 | 0.72 |
| Metal/ | Fresh | 0.1 M $Cs_2SO_4$ | 3.31 | 0.86 |
| Painted | | | 1.60 | N.D. |
| Metal/ | Soiled | Tap Water | 2.97 | 6.94 |
| Painted | | | 1.25 | 1.68 |
| Metal/ | Soiled | 0.1 M $Cs_2SO_4$ | 3.50 | 1.94 |
| Painted | | | 0.89-1.19 | 0.53-1.24 |

TABLE 8

Results of pre plus post treatment for $^{137}Cs$

| Spl. Name | Finish | History | Pre-Treatment | $^{137}Cs$ Retained ($10^{-3}$ μCi) | Post-treat | $^{137}Cs$ ($10^{-3}$ μCi) % Removed |
|---|---|---|---|---|---|---|
| M1U | Metal | Fresh | Tap Water | 2.62 | Tap | 0.86, 67% |
| | | | | ***2.44*** | | |
| M2U | Metal | Fresh | 0.1 M $Cs_2SO_4$ | 0.86 | Tap | N.D., |
| | | | | ***0.40*** | | ~100% |
| M3G | Metal | Soiled | Tap Water | 6.94 | Tap | 1.31, 81% |
| | | | | **43.0** | | |
| M4G | Metal | Soiled | 0.1 M $Cs_2SO_4$ | 1.94 | Tap | N.D. |
| | | | | ***4.24*** | | ~100% |
| P1G | Painted | Soiled | 0.1 M $K_2SO_4$ | 3.76 | K | 1.36, 64% |
| P2G | Painted | Soiled | 0.1 M $(NH_4)_2SO_4$ | 2.83 | NH4 | 0.83, 71% |
| P3G | Painted | Soiled | Tap Water | 1.68 | Tap | N.D., ~100% |
| P4G | Painted | Soiled | 0.1 M $Cs_2SO_4$ | 0.74 | Dl | 0.34, 54% |
| P5G | Painted | Soiled | 0.1 M $Cs_2SO_4$ | 1.24 | Tap | N.D., ~100% |

TABLE 8-continued

Results of pre plus post treatment for $^{137}Cs$

| Spl. Name | Finish | History | Pre-Treatment | $^{137}Cs$ Retained ($10^{-3}$ μCi) | Post-treat | $^{137}Cs$ ($10^{-3}$ μCi) % Removed |
|---|---|---|---|---|---|---|
| P6G | Painted | Soiled | 0.1 M $Cs_2SO_4$ | 0.53 | Dl | N.D., ~100% |
| P7U | Painted | Fresh | 0.1 M $Cs_2SO_4$ | N.D. | Tap | N.D., ~100% |
| P8U | Painted | Fresh | 0.1 M $K_2SO_4$ | N.D. | Tap | N.D., ~100% |
| P9U | Painted | Fresh | Tap Water | 0.72 | Tap | N.D., ~100% |
| P10U | Painted | Fresh | 0.1 M $Cs_2SO_4$ | N.D. | Tap | N.D., ~100% |

Bold Italic results are from the previous trial and are averages of four replicate measurements.

TABLE 9

Results of pre and post treatment for $^{60}Co$

| Spl. Name | Finish | History | Pre-Treatment | $^{60}Co$ Retention ($10^{-3}$ μCi) | Post-Treat | $^{60}Co$ Retention ($10^{-3}$ μCi) |
|---|---|---|---|---|---|---|
| M1U | Metal | Fresh | Tap Water | 2.51 ***2.36*** | Tap | N.D., ~100% |
| M2U | Metal | Fresh | 0.1 M $Cs_2SO_4$ | 3.31 ***2.43*** | Tap | 1.06, 68% |
| M3G | Metal | Soiled | Tap Water | 2.97 **2.61** | Tap | 0.90, 69% |
| M4G | Metal | Soiled | 0.1 M $Cs_2SO_4$ | 3.50 ***2.77*** | Tap | 1.19, 66% |
| P1G | Painted | Soiled | 0.1 M $K_2SO_4$ | 1.38 | K | N.D., ~100% |
| P2G | Painted | Soiled | 0.1 M $(NH_4)_2SO_4$ | 1.53 | NH4 | N.D., ~100% |
| P3G | Painted | Soiled | Tap Water | 1.25 | Tap | N.D., ~100% |
| P4G | Painted | Soiled | 0.1 M $Cs_2SO_4$ | 0.89 | Dl | N.D., ~100% |
| P5G | Painted | Soiled | 0.1 M $Cs_2SO_4$ | 1.19 | Tap | 0.55, 54% |
| P6G | Painted | Soiled | 0.1 M $Cs_2SO_4$ | 1.04 | Dl | N.D., ~100% |
| P7U | Painted | Fresh | 0.1 M $Cs_2SO_4$ | 1.60 | Tap | 0.41, 74% |
| P8U | Painted | Fresh | 0.1 M $K_2SO_4$ | 1.33 | Tap | N.D., ~100% |
| P9U | Painted | Fresh | Tap Water | 0.96 | Tap | N.D., ~100% |
| P10U | Painted | Fresh | 0.1 M $Cs_2SO_4$ | 1.38 | Tap | N.D., ~100% |

Bold Italic results are from the previous trial and are averages of four replicate measurements.

For the unpainted coupons the trends observed are similar to those noted in previous tests except, in this case the loading of road grime was somewhat less so the difference in $^{137}Cs$ loading between soiled and unsoiled coupons was smaller. For the painted samples:

1. In all cases painting had a beneficial effect in cutting down on the amounts of both $^{60}Co$ and $^{137}Cs$ that were retained on the surfaces during the initial loading process (Table 7).
2. Again, soiling the surface resulted in a significant increase in Cs (but not Co) retention relative to samples that had not been exposed to simulated road grime.
3. Tap water was the only pretreatment that was not effective at eliminating retained $^{137}Cs$ for samples that were not exposed to simulated road grime. However, it was (marginally) the most effective agent in diminishing retention of $^{60}Co$. For soiled samples the beneficial impact of a tap-water wash seems to disappear for preventing the uptake of cobalt.
4. For soiled samples with painted surfaces the beneficial effect of a Cs pre-wash relative to a tap water pre-wash is again visible but not as large as with the previous suite of samples.
5. Treatment with ammonium or potassium may have actually made things worse for painted—soiled samples, possibly because they saturated the exchange sites with something that cesium could readily displace. A very slight tendency toward this trend was apparent for the metal-finish samples in the first suite of tests but not for the samples exposed to road grime. However, in the current testing the amount (and impact) of road grime on the samples is smaller so the effect of the coatings placed on the coupon surfaces may be playing a larger relative role in overall responses.
6. For final Cs removal tap water and deionized water performed better than either ammonium or potassium solutions on both clean and soiled painted surfaces. For cobalt removal only tap water left enough contamination so that a signal was still detectable.

In a regional sense it is likely that the pH of the spent fuel storage ponds may vary from slightly basic to slightly acidic, though the best-documented pH is about 5.6 (Jawarani et al., supra). Consequently a small experimental matrix (Tables 10 and 11) was carried out where the coupons were pre and post treated with normal tap water but the pH of the Cs and Co loading solutions was adjusted downward to a pH near 6 and upward to 8 (initial loading experiments, Tables 2-6 had a pH of 7.3). With regard to pre and post-treatment these samples compare to results in the upper left entry of Tables 3-6 and were loaded at the same time that these coupons were (i.e., not with the later suite of samples that were loaded for the painted and unpainted comparison in the preceding section).

TABLE 10

Cobalt uptake from solutions with a pH of about 6 and about 8 and effect of subsequent soaking in tap water after being loaded. (All coupons were pre-treated with tap water)

| Exposure Solution | As Machined | Soiled by Road Grime |
|---|---|---|
| pH 6 | 3.85 to 2.19 | 3.04 to 1.96 |
| pH 6 | 3.12 to 2.50 | 2.23 to 1.73 |
| pH 8 | 47.3 to 41.4 | 25.3 to 17.7 |
| pH 8. | 42.9 to 36.9 | 23.0 to 16.1 |

TABLE 11

Cesium uptake from solutions with a pH of about 6 and about 8 and effect of subsequent soaking in tap water after being loaded. (All coupons were pre-treated with tap water)

| Exposure Solution | As Machined | Soiled by Road Grime |
|---|---|---|
| pH 6 | 2.96 to 0.40 | 40.1 to 13.6 |
| pH 6 | 2.43 to not detectable | 34.7 to 12.4 |
| pH 8 | 3.09 to not detectable | 36.4 to 12.3 |
| pH 8. | 2.89 to not detectable | 31.6 to 10.0 |

The pH of the $^{137}Cs$ treating solution had no obvious effect on the uptake of $^{137}Cs$ but the treatment with road grime clearly did. Soaking the loaded coupons in tap water removed almost all of the Cs that was sorbed by clean metal surfaces and about two thirds of the cesium that was sorbed by surfaces soiled by road grime.

The largest factor in governing the uptake of $^{60}Co$ is the pH of the loading solution. Possible explanations include (a) the (unlikely) formation of particulate $Co(OH)_2$ particles or (b) the fact that the Co sorbing sites are more receptive to cation sorption at high pH values (as would be expected of sorption sites on the surfaces of metal oxides). It also appears that exposure to road grime blocked about 40% of these sites. Soaking the loaded coupons in tap water left a significant fraction of the cobalt that had loaded onto the surfaces without regard to whether the surfaces were clean or soiled or whether the surfaces had been loaded at high or low pH.

Earlier studies had shown that washing a shipping cask after immersion in contaminated water was likely to provide a higher level of overall decontamination than was achievable by simply blocking the sorption sites prior to immersion. These studies also suggested that reversing the ion exchange process to displace Cs using either potassium or ammonium were not significantly more effective than just washing the contaminated surface with low ionic strength solutions such as tap water. The underlying cause is, of course, that during sorption the clay layers come together to encapsulate the Cs. This prevents it from having ready access to fluids on the surface of the clay particle. Reversing the ion exchange is, thus, generally a slow and inefficient process. To get around this difficulty a number of chemical washes were selected with the potential for simply dissolving at least the outer layer of the clay particles where the balance of the sorbed Cs should reside. These reagents were selected based on their ability to complex aluminum or silicon, the principal elements making up the backbone of the clay structure.

The road grime needed for these tests was loaded with Cs by exposing 8.077 grams of material to 101.7 grams of a solution containing 10 parts per thousand-dissolved (non-radioactive) Cs for a period of 15 days at room temperature. After the loading period the fluid was repeatedly decanted off and replaced with fresh batches of deionized water for a period of six weeks. Finally, the Cs-loaded road grime was allowed to equilibrate with the final wash solution for another six-week period. At the conclusion of the equilibration period the water contained about 20 ppm Cs, 0.02 ppm Al and 6.5 ppm Si, and the bottle contained about 400 ml of fluid.

Stock solutions of each of the complexing agents were prepared by dissolving them in deionized water. In some cases not all of the salt dissolved, in which case the concentration in the stock solution (Table 12) is simply listed as "saturated".

TABLE 12

Concentrations of complexing agents used in Cs release studies

| Agent | Grams Water | Grams Agent |
|---|---|---|
| $(NH_4)_2SiF_6$ | 27 | 4.96 |
| Sodium Salicylate | 19.6 | 5.01 |
| Salicylic Acid | saturated | saturated |
| Gallic Acid | saturated | saturated |
| Oxalic Acid | 35.7 | 5.00 |
| Catechol | 35.8 | 5.03 |
| 8-Hydroxyquinoline | saturated | saturated |
| Di-Sodium EDTA | saturated | saturated |

TABLE 12-continued

Concentrations of complexing agents used in Cs release studies

| Agent | Grams Water | Grams Agent |
|---|---|---|
| Di-Sodium Chromotropic Acid | 17.9 | 1.22 |
| Glutamic Acid | saturated | saturated |
| Sodium Isosaccharinic Acid | 17.9 | 1.00 |

The bottle containing the Cs-loaded road grime was then shaken vigorously to suspend the solids and 18 ml of suspension was pipetted into each of 11 polyethylene bottles. The process went quickly and the vigorous shaking was maintained until all the bottles were loaded. Consequently it is reasonable to assume that all of the bottles contained about the same mass of road grime as well as the same volume of fluid. Next, one ml of the various complexing agent stock solutions was added, individually, into one of the slurry-filled bottles. The bottles sat at room temperature for 7 days and then an aliquot of fluid was removed, passed through a 0.2-micron filter and analyzed for Al, Si and Cs. In addition, reagent blanks were run to see if the complexing agents themselves could introduce Cs that might be mistaken for Cs that had been leached from the road grime. However, the reagent blanks were all clean so any increment in Cs in the test fluid must reflect Cs released from the road grime.

In addition to giving the Al, Si and Cs concentrations for each leach test solution the far right hand column in Table 13 is a metric that highlights the best performers (Cs-f is final Cs concentration and Cs-i is that concentration of the initial Cs in the fluid, 20 ppm). It is evident that a number of agents successfully scavenged Cs from the clays in the road grime. In order of decreasing efficiency they are: $(NH_4)_2SiF_6$ (ammonium fluorosilicate)>oxalic acid>disodium chromotropic acid>glutamic acid>sodium salicylate. Since these samples had already equilibrated for a considerable period of time with fresh water it is likely that any of these solutions would be superior to the post-wash fluids that were previously evaluated. It is also noteworthy that it should be possible to use ammonium fluorosilicate and oxalic acid together since the former specifically targets the silica in the clay structure while the latter is effective only against metals such as aluminum, iron and magnesium (and potentially cobalt as well).

TABLE 13

Leaching Test Results

| Agent | Al ppm | Cs ppm | Si ppm | (Cs − f/Cs − i) − 1 |
|---|---|---|---|---|
| $(NH_4)_2SiF_6$ | 6.57 | 34.8 | 1672 | 0.736 |
| Sodium Salicylate | 1.11 | 22.9 | 8.29 | 0.141 |
| Salicylic Acid | 0.017 | 20.71 | 6.25 | 0.031 |
| Gallic Acid | 0.052 | 21.6 | 10.3 | 0.079 |
| Oxalic Acid | 39.8 | 30.8 | 73.8 | 0.539 |
| Catechol | 1.79 | 21.2 | 12.5 | 0.060 |
| 8-Hydroxyquinoline | 0.03 | 19.9 | 7.07 | −0.009 |
| Di-Sodium EDTA | 3.79 | 17.8 | 12.19 | −0.113 |
| Di-Sodium Chromotropic Acid | 1.74 | 25.9 | 9.41 | 0.291 |
| Glutamic Acid | 0.011 | 24.3 | 6.70 | 0.212 |
| Sodium Isosaccharinic Acid | 0.266 | 20.8 | 7.20 | 0.039 |
| Starting Fluid | 0.019 | 20.0 | 6.48 | 0 |

The preceding examples can be repeated with similar success by substituting the generically or specifically described reactants and/or operating conditions of this invention for those used in the preceding examples.

A main thrust of the present invention is to block Cs-sorbing sites prior to exposing metal or painted surfaces to contaminated waters. However, an alternate approach attacks the aluminosilicate minerals that scavenge the Cs prior to placing the surface in contact with a source of contamination. Table 13 indicates that several reagents have this ability since at the conclusion of the tests dissolved levels of Al, Si and occasionally both were above those in the starting solutions. Thus, in addition to prewashing with monovalent cations it may be advantageous to also use chemicals such as are tabulated in Table 13 as part of the pre-wash procedure, either separately or mixed together with the monovalent cation containing solutions.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of treating the surface of a steel package, in order to reduce contamination by radioactive cesium, the method comprising the steps of:

a) providing a steel package;

b) prior to exposing the package to radioactive cesium, pre-washing the package with a cation-containing pre-wash solution having a pH greater then about 6 and less than about 8, the pre-wash cation being selected from one or more of the group consisting of $Na^+$, $Li^+$, $Cs^+$, $Rb^+$, $Ag^+$, $Tl^+$, $K^+$, and $NH_4^+$;

c) exposing the package to radioactive cesium; and d) after exposing the package to radioactive cesium, post-washing the package with a cation-containing post-wash solution having a pH greater than about 6 and less than about 8, the post-wash cation being selected from one or more of the group consisting of $Na^+$, $Li^+$, $Rb^+$, $Ag^+$, $Tl^+$, $K^+$, and $NH_4^+$;

wherein the pre-wash solution comprises a cesium salt selected from the group consisting of cesium sulfate, cesium chloride, cesium nitrate, and cesium acetate.

2. The method of claim 1 wherein the concentration of $Cs^+$ in the pre-wash solution is greater than approximately 0.1 molar.

3. The method of claim 1 wherein the cation in the post-wash solution is selected from the group consisting of $K^+$ and $NH_4^+$_.

4. The method of claim 3 wherein the concentration of $K^+$ in the post-wash solution is greater than approximately 0.1 molar.

5. The method of claim 3 wherein the concentration of $NH_4^+$ in the post-wash solution is greater than approximately 0.1 molar.

6. The method of claim 1 wherein the cation used in the pre-wash solution is different that the cation used in the post-wash solution.

7. The method of claim 1 wherein the post-wash solution additionally comprises one or more complexing agents selected from the group consisting of ammonium fluorosilicate, oxalic acid, disodium chromotropic acid, glutamic acid, and sodium salicylate.

8. The method of claim 1, wherein the pre-wash solution additionally comprises one or more complexing agents selected from the group consisting of ammonium fluorosilicate, oxalic acid, disodium chromotropic acid, glutamic acid, and sodium salicylate.

9. The method of claim 1, wherein the steel package comprises a spent fuel shipping cask.

10. The method of claim 1, wherein the cation in the post-wash solution is $K^+$.

11. The method of claim 1, wherein the surface of the steel package is contaminated with clay.

* * * * *